US008505427B2

(12) United States Patent
Wilson et al.

(10) Patent No.: US 8,505,427 B2
(45) Date of Patent: Aug. 13, 2013

(54) ORDNANCE NEUTRALIZATION METHOD AND DEVICE USING ENERGETIC COMPOUNDS

(75) Inventors: Dennis Eugene Wilson, Austin, TX (US); Kurt Anthony Schroder, Coupland, TX (US)

(73) Assignee: NCC Nano, LLC, Dallas, TX (US)

( * ) Notice: Subject to any disclaimer, the term of this patent is extended or adjusted under 35 U.S.C. 154(b) by 1683 days.

(21) Appl. No.: 11/593,947

(22) Filed: Nov. 6, 2006

(65) Prior Publication Data

US 2008/0028922 A1 Feb. 7, 2008

Related U.S. Application Data

(60) Provisional application No. 60/834,992, filed on Aug. 2, 2006.

(51) Int. Cl.
*F42B 33/00* (2006.01)
*F42B 12/44* (2006.01)

(52) U.S. Cl.
USPC ..... 89/1.13; 102/364

(58) Field of Classification Search
USPC ..... 89/1.13; 102/364, 475, 476
See application file for complete search history.

(56) References Cited

U.S. PATENT DOCUMENTS

| | | | | |
|---|---|---|---|---|
| 3,425,316 | A * | 2/1969 | Nixon et al. | 89/1.818 |
| 3,483,312 | A * | 12/1969 | McDonald et al. | 174/87 |
| 3,565,706 | A * | 2/1971 | Waite | 149/19.3 |
| 3,664,262 | A * | 5/1972 | Rose et al. | 102/476 |
| 3,865,035 | A * | 2/1975 | Munson et al. | 102/364 |
| 4,480,551 | A * | 11/1984 | LoFiego | 102/245 |
| 4,917,017 | A * | 4/1990 | Beltz | 102/470 |
| 5,417,160 | A * | 5/1995 | Mei et al. | 102/289 |
| 7,603,951 | B2 * | 10/2009 | Rose et al. | 102/364 |
| 2003/0037692 | A1 * | 2/2003 | Liu | 102/301 |
| 2006/0011086 | A1 * | 1/2006 | Rose et al. | 102/364 |
| 2006/0266204 | A1 * | 11/2006 | Givens et al. | 89/1.14 |

* cited by examiner

*Primary Examiner* — B C Hayes
(74) *Attorney, Agent, or Firm* — Antony P. Ng; Yudell Isidore Ng Russell PLLC

(57) ABSTRACT

This invention generally relates to a method and apparatus to neutralize ordnance, more specifically improvised explosive devices (IEDs) and unexploded ordnance (UXOs). The current invention provides a simple method to neutralize the ordnance by taking advantage of a new class of energetic materials that includes nano-thermites, binary thermites and additionally powdered thermites. In the invention, a projectile is loaded with the new class of energetic materials and fired into the ordnance. The impact causes the energetic materials to react in such a fashion that the explosive compound or other material within the IED or UXO is burned in a self-propagating mode without exploding. Hence, the ordnance is neutralized.

12 Claims, 3 Drawing Sheets

ORDNANCE NEUTRALIZATION METHOD AND DEVICE USING ENERGETIC COMPOUNDS

CROSS REFERENCE TO RELATED APPLICATIONS

This application claims the benefit of Provisional Application No. 60/834,992 filed Aug. 2, 2006.

FIELD OF THE INVENTION

This invention generally relates to a method and apparatus to neutralize explosive devices, and more specifically to improvised explosive devices (IEDs) and unexploded ordnance (UXOs). The current invention provides a simple method to neutralize such explosive devices by taking advantage of a new class of energetic materials called nano-thermites, binary thermites, and, additionally, powdered thermites. More particularly, the invention relates to a projectile that is loaded with the new class of materials and fired into the IED or UXO. The impact causes the nano-energetic materials to react in such a fashion that the explosive compound and/or material within the IED or UXO is burned in a self-propagating mode without exploding. Hence, the IED or UXO is neutralized.

BACKGROUND OF THE INVENTION

On the battlefield, the neutralization of UXOs, land mines and IEDs tend to fall into a gray area between the overlapping capabilities of combat engineers and explosive ordnance disposal (EOD) teams. One common strategy is to identify threats, mark them, move around them, and subsequently neutralize them. Neutralization strategies range from destroying the threat with explosives, destroying it with another munition, burning it, or physically disarming it.

Neutralizing the device using another explosive or munition generally results in a high order/high explosive effect. This process requires many considerations. For example, if the UXO is in a highly populated or public place, the detonation of the UXO can cause harm to people and personel as well as damaging the surrounding buildings and infrastructures. In these cases, neutralization of the UXO requires very specialized equipment and highly trained individuals. Many times, neutralization requires the specialized personnel to closely interact with the UXO or LED and puts them at considerable risk. However, in a battle field environment, these personel and techniques may not be readily available. Therefore there is a need for a simple solution to neutralize UXOs and IEDs that does not require highly specialized equipment and training.

Physically disarming a UXO or IED is sometimes required, but it requires extremely intimate interaction with the device and highly specialized equipment and personel. In the battle field, IEDs have become much more complex using remote triggering devices, as well as conventional triggering devices. Thus, it is possible that an IED can be detonated by the enemy while it is being disarmed. This greatly enhances the risk to personel. Hence, there is a need to minimize intimate personel contact with the UXO and IED when neutralizing it.

A method to minimize the potential damage while neutralizing a UXO or IED is to use non-explosive neutralization methods, such as those developed at the U.S. Army Communications Electronics Command. These methods include propellants, thermites and pyrotechnics and are designed to neutralize the device by deflagration (also referred to as burning or combustion) instead of detonation of the mine's main charge. Known non-explosive technologies for clearing mines and UXOs are (a) bullet with chemical capsule (BCC); bullet carrying chemical; reactive mine clearance (REMIC and REMIC-II); thermites; Mine Incinerator; Pyrotechnic Torch, and Humanitarian Demining Flare ( manufactured by Thiokol).

Four of the more common systems are briefly described herein. The first two methods were developed under the Department of Defense Humanitarian Demining R&D Program; the third method was developed by the United Kingdom's Defense Establishment Research Agency (DERA); and the fourth method was developed under the direction of the U.S. Army Space and Missile Defense Command (SMDC).

The Humanitarian Demining Flare neutralizes mines by quickly burning through the casing and igniting the explosive fill without detonation. [See D. L. Patel, J. J. Regnier and S. P. Burke, "Humanitarian Demining Flare against Cluster Munitions and Hard Cased Landmines," *U.S. Army CECOM, Night Vision and Electronic Sensors Directorate,* 2002] The flare is made from surplus solid rocket propellant manufactured by Thiokol for the Space Shuttle Program. The flare is positioned next to the mine or IED such that the low-thrust flame with an average temperature in excess of 3500° F. (2260° K) can burn through the mine's casing. The burn time of the flare can be controlled by altering the diameter and length of the flare. Typically, the flare is remotely actuated. A present embodiment of the Thiokol Flare is 5 inches long, one inch in diameter and burns for approximately 70 seconds.

Two other similar devices to the Humanitarian Demining Flare are the Mine Incinerator (MI) and the FireAnt. [See D. L. Patel, "Can Currently Developed Deflagration Systems Neutralize Hard Case Mines?", *UXO/Countermine Forum Conference Proceedings,* Apr. 9-12, 2001, New Orleans, USA; A. J. Tulis, J. L. Austing and D. L. Patel, "Rocket-Concept Pyrotechnic-Propellant Torch for the Non-Detonative Neutralization of Mines and UXO," *Technologies of Mine Countermeasures,* Mar. 27-29, 2001, Sydney, Australia] The MI is based on a self-propagating solid-state reaction (conventional thermite). This device is also positioned within close proximity of the mine such that its liquid reaction products with a temperature up to 4000° K can burn through the mine's casing and burn the explosive material. The FireAnt is a pyrotechnic device designed to burn the explosives contained within a mine's casing. It contains a composition of aluminum, barium nitrate, and polyvinyl chloride (PVC). It contains about 80 gm of composition sealed in a 23.7 cm long, 3.9 cm diameter cardboard cylinder. An electrical match is inserted in the pyrotechnic mixture at the bottom of the cylinder and then it is placed above the UXO. A battery or a demolition device ignites the electrical match. The mixture burns at 1830° K for around 23-24 seconds.

While these methods overcome the issues associated with the exploding the UXO and they are relatively simple, they still require personnel to intimately interact with the UXO. Hence, there is still a need for a simple and safe method to neutralize the UXOs.

One method that has addressed the issue associated with the intimate contact with the UXO is the Zeus-Humvee laser ordnance neutralization system (HLONS) developed under the direction of the U.S. Army SMDC. [S. R Gourley, "Zeus-Humvee Laser Ordnance Neutralization System," *Army Magazine* 54, December 2004] This method represents the first high-power laser weapon system to successfully engage and neutralize unexploded ordnance (UXO). The system integrates an up-armored Humvee with a solid-state laser that has an effective stand-off engagement range of up to 300 meters against UXO and surface-laid land mines. The laser neutralizes or negates the ordnance by focusing energy on the outer casing of the target, heating the munition until it is destroyed by internal combustion. The combustion created by the laser produces low-level detonations rather than activating the explosive power designed into land mines and UXOs. This system is quite complex, is expensive and still requires specially trained personnel to operate the equipment.

Hence, while the current state of the art each address certain aspects of the issues associated with neutralizing a UXO or IED, there is still a need for a simple, inexpensive and safe method for neutralizing explosive devices, particularly IEDs, and UXOs.

BRIEF DESCRIPTION OF THE INVENTION

Briefly, the present invention provides for an apparatus or device for neutralizing explosive devices and weapons (collectively "ordnance") containing explosive material that comprises a projectile containing energetic material, wherein, when the projectile contacts and penetrates the ordnance, the energetic material reacts with the explosive material of the ordnance to neutralize the ordnance. In one embodiment of the present invention, a novel apparatus or device uses a new class of materials referred to as Metastable Intermolecular Composites (MIC) or nano-thermites to simply and safely neutralize ordnance, particularly those in the form of IEDs and UXOs. Such new materials are commonly identified as nano-energetic materials. The apparatus is comprised of a small amount of the nano-energetic material packaged within a projectile that is launched from a small caliber rifle, kinetic energy gun, or other suitable launcher. Upon impact with the ordnance, the projectile penetrates the ordnance casing and the impact causes the nano-energetic material to react and neutralize the explosive material within the ordnance. The new apparatus eliminates the need for personnel to be in close or in intimate proximity to the ordnance and eliminates the need for highly specialized personnel and equipment.

In another embodiment of the present invention, the fuel and oxidizer of the MIC composite are segregated so that the projectile is less sensitive to handling issues (such as electrical static discharges), but still retains that ability to react upon impact and neutralize the explosive material within the UXO, IED, land mine or other ordnance.

In another embodiment of the present invention, a powdered thermite is packaged into the projectile, such that, upon impact, the powdered thermite reacts and neutralizes the explosive material in the IED, UXO, or other ordnance. In that circumstance, the powder may be compacted or loosely contained within the projectile.

In another embodiment of the present invention, metals that form intermetallic compounds via an exothermic reaction are packaged into the projectile, such that, upon impact, they react and neutralize the explosive material within the IED, UXO or other ordnance. Preferably the metals are powdered with a size in the low to submicron range. The metals may be compacted or loosely contained within the projectile. Additionally the metals may be segregated within the projectile to reduce their reaction sensitivity.

In another embodiment of the present invention, an oxidizer or metal that reacts with at least one of the projectile casing or the ordnance casing is packaged into the projectile. This allows more energy to be released at the target by using the projectile body or ordnance casing as the fuel source.

Additionally, a method for neutralizing the explosive material within an UXO, IED, or other ordnance is disclosed. The method involves loading a projectile with the energetic material, firing the projectile from a small caliber rifle, kinetic energy gun or other suitable launcher, and having the projectile penetrate the ordnance casing. The impact with the casing causes the energetic material to react and subsequently burn the explosive material within the UXO, IED or other ordnance. In this manner, the current invention provides a safe method that does not require complex equipment and specialized personnel to neutralize UXOs, IEDs or other ordnance.

DEFINITIONS

Figure 1:
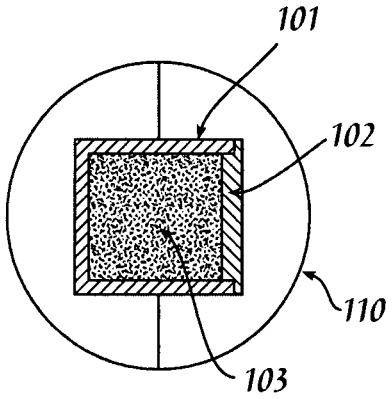
FIG. 1 shows a schematic of an embodiment of the present invention having an aluminum shell containing energetic material where the shell is encased within a sphere.

"Improvised Explosive Device" and "IED" shall mean a device placed or fabricated in an improvised manner incorporating destructive, lethal, noxious, pyrotechnic, or incendiary chemicals and designed to destroy, incapacitate, harass, or distract. It may incorporate military stores, but is normally devised from nonmilitary components. An IED typically consists of an explosive charge, possibly a booster charge, a detonator and a mechanism either mechanical or electronic, known as the initiation system. IEDs are extremely diverse in design, and may contain any type of firing device or initiator, plus various commercial, military, or contrived chemical or explosive fillers. IEDs are mostly conventional high-explosive charges, also known as homemade bombs. However, there is the threat that toxic chemical, biological, or radioactive (dirty bomb) material can be included to add to the destructive power and psychological effect of the device. Device placement is generally based on ease of concealment, and the likelihood that an appropriate target (frequently a US military vehicle) will pass close by.

"Unexploded Ordnance" and "(UXO)" shall mean an explosive weapon (such as a bomb, shell, grenade, etc.) that did not explode when it was employed, and still poses a risk of detonation, some time afterwards (even decades after the battle in which it was used). An explosive ordnance that has been primed, fused, armed or otherwise prepared for use or used but did not detonate is an UXO. The UXO could have been fired, dropped, launched, or projected yet remains unexploded either through malfunction or design or for any other cause.

"Deflagration" shall mean combustion that propagates through a gas or along the surface of an explosive at a rapid rate driven by the transfer of heat; a reaction (typically chemical) accompanied by a vigorous evolution of heat, flame or spattering of burning particles. Although deflagration is classed as an explosion, generally this term implies the burning (exothermic chemical reaction) of a substance with self-contained oxygen so that the reaction zone advances into the unreacted material at less than the velocity of sound in the material. During deflagration, heat is transferred from the reacted to the unreacted material by conduction, convection and radiation. Burning rates are usually less than about 2,000 m/s.

"Detonation" shall mean an explosion; a violent release of energy caused by a reaction (such as chemical or nuclear); a reaction front (typically chemical) that moves through an explosive material at a velocity greater than the speed of sound in the material. During a detonation, energy is transmitted from the reacted to the unreacted material by a shock wave through the high-temperature and high-pressure gradients generated at the wave front. The reaction generally occurs on a sub-microsecond time scale. Detonation velocities typically lie in the approximate range of about 2,000 m/s to about 9,000 m/s.

"Nano-Energetic Material," "Metastable Intermolecular Composite" and "(MIC)" shall mean a special class of materials generally consisting a of metal and a metal oxidizer in which one of the components has at least one nanoscale (less than about 500 nm) dimension and the pair form a reduction-oxidation reaction when activated.

"Binary Energetic Material" shall mean a special class of energetic materials in which the components are segregated. Generally, the components are mixed upon impact.

"Powdered Thermite Material" shall mean a thermite pair of materials generally comprising a metal and a metal oxidizer that forms a reduction-oxidation reaction when activated. At least one of the components is a micron or sub-micron powder.

DETAILED DESCRIPTION

In one embodiment, the current invention uses a new class of materials often referred to as Metastable Intermolecular Composites (MIC), nano-energetics or nano-thermites. A key interest in MIC lies in its ability to release energy in a controllable fashion, coupled with its high energy density and variable mass density. It has become the most studied subset of nano-energetics, primarily because of its unusual and interesting characteristics, which are listed below:

Super high-temperatures~6000° K

Higher energy density than organic explosives~2×

Variable mass density~3 to 14 g/cc.

Tunable energy release rate~4 orders of magnitude

By-products are benign~"green" applications

MIC formulations generally consist of metal, such as nano-aluminum (i.e., aluminum having at least one nanoscale dimension), plus a suitable metal oxidizer, such as bismuth trioxide or iron oxide, such that a reduction-oxidation (redox) reaction occurs between the components. Examples of the metal (or fuel) that can utilized in MIC formulations include: aluminum, magnesium, tantalum, zirconium, tungsten, haffium, beryllium and combinations thereof. Examples of oxidizers include: bismuth trioxide, tantalum pentoxide, iron (III) oxide, iron (II, III) oxide, tungsten(IV) oxide, tungsten (VI) oxide, lead oxide, copper oxide, silver oxide, molybdenum trioxide and combinations thereof. One advantage of these reaction components is the ability to create formulations with high densities, which are desirable for ballistics such as bullets and reactive fragments. For example, the following formulations have high densities compared to common explosive materials, which are typically in the 1-2 grams/cc range.

$2\ Al+Bi_2O_3$=7.188 g/cc $Ta+5\ WO_2$=13.52 g/cc

Other thermite reactions are shown in the following table

TABLE 1a

Thermite Reactions (in Alphabetical Order)

| reactants | | adiahatic reaction temperture (K) | | state of products | | gas production | | heat of reaction | |
|---|---|---|---|---|---|---|---|---|---|
| constituents | $\rho_{TMD}$, g/cm$^3$ | w/o phase changes | w/phase changes | state of oxide | state of metal | moles gas per 100 g | g of gas per g | −Q, cal/g | −Q, cal/cm$^3$ |
| $3Al + 3AgO$ | 6.085 | 7503 | 3253 | l-g | gas | 0.7519 | 0.8083 | 896.7 | 5457 |
| $2Al + 3Ag_2O$ | 6.386 | 4941 | 2436 | liquid | l-g | 0.4298 | 0.4636 | 504.8 | 3224 |
| $2Al + B_2O_3$ | 2.524 | 2621 | 2327 | s-l | solid | 0.0000 | 0.0000 | 780.7 | 1971 |
| $2Al + Bi_2O_3$ | 7.188 | 3995 | 3253 | l-g | gas | 0.4731 | 0.8941 | 506.1 | 3638 |
| $2Al + 3CoO$ | 5.077 | 3392 | 3201 | liquid | l-g | 0.0430 | 0.0254 | 824.7 | 4187 |
| $8Al + 3Co_3O_4$ | 4.716 | 3938 | 3201 | liquid | l-g | 0.2196 | 0.1294 | 1012 | 4772 |
| $2Al + Cr_2O_3$ | 4.190 | 2789 | 2327 | s-l | liquid | 0.0000 | 0.0000 | 622.0 | 2606 |
| $2Al + 3CuO$ | 5.109 | 5718 | 2843 | liquid | l-g | 0.5400 | 0.3431 | 974.1 | 4976 |
| $2Al + 3Cu_2O$ | 5.280 | 4132 | 2843 | liquid | l-g | 0.1221 | 0.0776 | 575.5 | 3039 |
| $2Al + Fe_2O_3$ | 4.175 | 4382 | 3135 | liquid | l-g | 0.1404 | 0.0784 | 945.4 | 3947 |
| $8Al + 3Fe_3O_4$ | 4.264 | 4057 | 3135 | liquid | l-g | 0.0549 | 0.0307 | 878.8 | 3747 |
| $2Al + 3HgO$ | 8.986 | 7169 | 3253 | l-g | gas | 0.5598 | 0.9913 | 476.6 | 4282 |
| $10Al + 3I_2O_5$ | 4.119 | 8680 | >3253 | gas | gas | 0.6293 | 1.0000 | 1486 | 6122 |
| $4Al + 3MnO_2$ | 4.014 | 4829 | 2918 | liquid | gas | 0.8136 | 0.4470 | 1159 | 4651 |
| $2Al + MoO_3$ | 3.808 | 5574 | 3253 | l-g | liquid | 0.2425 | 0.2473 | 1124 | 4279 |
| $10Al + 3Nb_2O_5$ | 4.089 | 3240 | 2705 | liquid | solid | 0.0000 | 0.0000 | 600.2 | 2454 |
| $2Al + 3NiO$ | 5.214 | 3968 | 3187 | liquid | l-g | 0.0108 | 0.0063 | 822.3 | 4288 |
| $2Al + Ni_2O_3$ | 4.045 | 5031 | 3187 | liquid | l-g | 0.4650 | 0.2729 | 1292 | 5229 |
| $2Al + 3PbO$ | 8.018 | 3968 | 2327 | s-l | gas | 0.4146 | 0.8591 | 337.4 | 2705 |
| $4Al + 3PbO_2$ | 7.085 | 6937 | 3253 | l-g | gas | 0.5366 | 0.9296 | 731.9 | 5185 |
| $8Al + 3Pb_3O_4$ | 7.428 | 5427 | 3253 | l-g | gas | 0.4215 | 0.8466 | 478.1 | 3551 |
| $2Al + 3PdO$ | 7.281 | 5022 | 3237 | liquid | l-g | 0.6577 | 0.6998 | 754.3 | 5493 |
| $4Al + 3SiO_2$ | 2.668 | 2010 | 1889 | solid | liquid | 0.0000 | 0.0000 | 513.3 | 1370 |
| $2Al + 3SnO$ | 5.540 | 3558 | 2876 | liquid | l-g | 0.1070 | 0.1270 | 427.0 | 2366 |
| $4Al + 3SnO_2$ | 5.356 | 5019 | 2876 | liquid | l-g | 0.2928 | 0.3476 | 686.8 | 3678 |
| $10Al + 3Ta_2O_5$ | 6.339 | 3055 | 2452 | liquid | solid | 0.0000 | 0.0000 | 335.6 | 2128 |
| $4Al + 3TiO_2$ | 3.590 | 1955 | 1752 | solid | liquid | 0.0000 | 0.0000 | 365.1 | 1311 |
| $16Al + 3U_3O_8$ | 4.957 | 1406 | 1406 | solid | solid | 0.0000 | 0.0000 | 487.6 | 2417 |
| $10Al + 3V_2O_5$ | 3.107 | 3953 | 3273 | l-g | liquid | 0.0699 | 0.0356 | 1092 | 3394 |
| $4Al + 3WO_2$ | 8.085 | 4176 | 3253 | l-g | solid | 0.0662 | 0.0675 | 500.6 | 4047 |
| $2Al + WO_3$ | 5.458 | 5544 | 3253 | l-g | liquid | 0.1434 | 0.1463 | 696.4 | 3801 |
| $2B + Cr_2O_3$ | 4.590 | 977 | 917 | liquid | solid | 0.0000 | 0.0000 | 182.0 | 835.3 |

TABLE 1a-continued

Thermite Reactions (in Alphabetical Order)

| reactants | | adiahatic reaction temperture (K) | | state of products | | gas production | | heat of reaction | |
|---|---|---|---|---|---|---|---|---|---|
| constituents | $\rho_{TMD}$, g/cm$^3$ | w/o phase changes | w/phase changes | state of oxide | state of metal | moles gas per 100 g | g of gas per g | −Q, cal/g | −Q, cal/cm$^3$ |
| 2B + 3CuO | 5.665 | 4748 | 2843 | gas | l-g | 0.4463 | 0.2430 | 738.1 | 4182 |
| 2B + $Fe_2O_3$ | 4.661 | 2646 | 2065 | liquid | liquid | 0.0000 | 0.0000 | 590.1 | 2751 |
| 8B + $3Fe_3O_4$ | 4.644 | 2338 | 1903 | liquid | liquid | 0.0000 | 0.0000 | 530.1 | 2462 |
| 4B + $3MnO_2$ | 4.394 | 3000 | 2133 | l-g | liquid | 0.3198 | 0.1715 | 773.1 | 3397 |
| 8B + $3Pb_3O_4$ | 8.223 | 4217 | 2019 | liquid | l-g | 0.4126 | 0.8550 | 326.9 | 2688 |
| 3Be + $B_2O_3$ | 1.850 | 3278 | 2573 | liquid | s-l | 0.0000 | 0.0000 | 1639 | 3033 |
| 3Be + $Cr_2O_3$ | 4.089 | 3107 | 2820 | s-l | liquid | 0.0000 | 0.0000 | 915.0 | 3741 |
| Be + CuO | 5.119 | 3761 | 2820 | s-l | liquid | 0.0000 | 0.0000 | 1221 | 6249 |
| 3Be + $Fe_2O_3$ | 4.163 | 4244 | 3135 | liquid | l-g | 0.1029 | 0.0568 | 1281 | 5332 |
| 4Be + $Fe_3O_4$ | 4.180 | 4482 | 3135 | liquid | l-g | 0.0336 | 0.0188 | 1175 | 4910 |
| 2Be + $MnO_2$ | 3.882 | 6078 | 2969 | liquid | gas | 0.9527 | 0.5234 | 1586 | 6158 |
| 2Be + $PbO_2$ | 7.296 | 8622 | 4123 | l-g | gas | 0.4665 | 0.8250 | 875.5 | 6387 |
| 4Be + $Pb_3O_4$ | 7.610 | 5673 | 3559 | liquid | gas | 0.4157 | 0.8614 | 567.8 | 4322 |
| 2Be + $SiO_2$ | 2.410 | 2580 | 2482 | solid | liquid | 0.0000 | 0.0000 | 936.0 | 2256 |
| 3Hf + $2B_2O_3$ | 6.125 | 2656 | 2575 | solid | liquid | 0.0000 | 0.0000 | 296.5 | 1816 |
| 3Hf + $2Cr_2O_3$ | 7.971 | 2721 | 2572 | solid | liquid | 0.0000 | 0.0000 | 302.3 | 2410 |
| Hf + 2CuO | 8.332 | 5974 | 2843 | solid | l-g | 0.3881 | 0.2466 | 567.6 | 4730 |
| 3Hf + $2Fe_2O_3$ | 7.955 | 5031 | 2843 | solid | l-g | 0.2117 | 0.1183 | 473.3 | 3765 |
| 2Hf + $Fe_3O_4$ | 7.760 | 4802 | 2843 | solid | l-g | 0.1835 | 0.1025 | 450.4 | 3496 |
| Hf + $MnO_2$ | 8.054 | 5644 | 3083 | s-l | gas | 0.3263 | 0.3131 | 534.6 | 4305 |
| 2Hf + $Pb_3O_4$ | 9.775 | 9382 | 4410 | liquid | gas | 0.2877 | 0.5962 | 345.9 | 3381 |
| Hf + $SiO_2$ | 6.224 | 2117 | 1828 | solid | liquid | 0.0000 | 0.0000 | 203.3 | 1265 |
| 2La + 3AgO | 6.827 | 8177 | 4173 | liquid | gas | 0.4619 | 0.4983 | 646.7 | 4416 |
| 2La + 3CuO | 6.263 | 6007 | 2843 | liquid | l-g | 0.3737 | 0.2374 | 606.4 | 3798 |
| 2La + $Fe_2O_3$ | 5.729 | 4590 | 3135 | liquid | l-g | 0.1234 | 0.0689 | 529.6 | 3034 |
| 2La + 3HgO | 8.962 | 7140 | >4472 | l-g | gas | .32-.43 | 0.65-1 | 392.0 | 3513 |
| 10La + $3I_2O_5$ | 5.501 | 9107 | >4472 | gas | gas | 0.3347 | 1.0000 | 849.2 | 4672 |
| 4La + $3MnO_2$ | 5.740 | 5270 | 3120 | liquid | gas | 0.3674 | 0.2019 | 593.4 | 3406 |
| 2La + 3PO | 8.207 | 4598 | 2609 | liquid | gas | 0.3166 | 0.6561 | 287.4 | 2359 |
| 4La + $3PbO_2$ | 7.629 | 7065 | >4472 | gas | gas | 0.3927 | 1.0000 | 518.8 | 3958 |
| 8La + $3Pb_3O_4$ | 7.789 | 5628 | 4049 | liquid | gas | 0.2841 | 0.5886 | 378.6 | 2949 |
| 2La + 3PdO | 7.769 | 5635 | 3237 | liquid | l-g | 0.2450 | 0.2606 | 536.2 | 4166 |
| 4La + $3WO_2$ | 8.366 | 3826 | 3218 | liquid | solid | 0.0000 | 0.0000 | 361.2 | 3022 |
| 2La + $WO_3$ | 6.572 | 5808 | 4367 | liquid | liquid | 0.0000 | 0.0000 | 445.8 | 2930 |
| 6Li + $B_2O_3$ | 0.891 | 2254 | 1843 | s-l | solid | 0.0000 | 0.0000 | 1293 | 1152 |
| 6Li + $Cr_2O_3$ | 1.807 | 2151 | 1843 | s-l | solid | 0.0000 | 0.0000 | 799.5 | 1445 |
| 6Li + CuO | 2.432 | 4152 | 2843 | liquid | l-g | 0.2248 | 0.1428 | 1125 | 2736 |
| 6Li + $Fe_2O_3$ | 1.863 | 3193 | 2510 | liquid | liquid | 0.0000 | 0.0000 | 1143 | 2130 |
| 8Li + $Fe_3O_4$ | 0.517 | 3076 | 2412 | liquid | liquid | 0.0000 | 0.0000 | 1053 | 2036 |
| 4Li + $MnO_2$ | 1.656 | 3336 | 2334 | liquid | l-g | 0.4098 | 0.2251 | 1399 | 2317 |
| 6Li + $MoO_3$ | 1.688 | 4035 | 2873 | l-g | solid | 0.2155 | 0.0644 | 1342 | 2265 |
| 8Li + $Pb_3O_4$ | 4.133 | 4186 | 2873 | l-g | liquid | 0.1655 | 0.0496 | 536.7 | 2218 |
| 4Li + $SiO_2$ | 1.177 | 1712 | 1687 | solid | s-l | 0.0000 | 0.0000 | 763.9 | 898.7 |
| 6Li + $WO_3$ | 2.478 | 3700 | 2873 | l-g | solid | 0.0113 | 0.0034 | 825.4 | 2046 |
| 3Mg + $B_2O_3$ | 1.785 | 6389 | 3873 | l-g | liquid | 0.4981 | 0.2007 | 2134 | 1195 |
| 3Mg + $Cr_2O_3$ | 3.164 | 3788 | 2945 | solid | l-g | 0.1023 | 0.0532 | 813.1 | 2573 |
| Mg + CuO | 3.934 | 6502 | 2843 | solid | l-g | 0.8186 | 0.5201 | 1102 | 4336 |
| 3Mg + $Fe_2O_3$ | 3.224 | 4703 | 3135 | liquid | l-g | 0.2021 | 0.1129 | 1110 | 3579 |
| 4Mg + $Fe_3O_4$ | 3.274 | 4446 | 3135 | liquid | l-g | 0.1369 | 0.0764 | 1033 | 3383 |
| 2Mg + $MnO_2$ | 2.996 | 5209 | 3271 | liquid | gas | 0.7378 | 0.4053 | 1322 | 3961 |
| 4Mg + $Pb_3O_4$ | 5.965 | 5883 | 3873 | l-g | gas | 0.4216 | 0.8095 | 556.0 | 3316 |
| 2Mg + $SiO_2$ | 2.148 | 3401 | 2628 | solid | l-g | 0.9200 | 0-.26 | 789.6 | 1695 |
| 2Nd + 3AgO | 7.244 | 7628 | 3602 | liquid | gas | 0.4544 | 0.4902 | 625.9 | 4534 |
| 2Nd + 3CuO | 6.719 | 5921 | 2843 | liquid | l-g | 0.3699 | 0.2350 | 603.4 | 4054 |
| 2Nd + 3HgO | 9.430 | 7020 | <5374 | gas | gas | 0.4263 | 1.0000 | 392.7 | 3703 |
| 10Nd + $3I_2O_5$ | 5.896 | 10067 | <7580 | gas | gas | 0.3273 | 1.0000 | 840.6 | 4956 |
| 4Nd + $3MnO_2$ | 6.241 | 5194 | 3287 | liquid | gas | 0.3580 | 0.1967 | 589.9 | 3682 |
| 4Nd + $3PbO_2$ | 8.148 | 6938 | <5284 | gas | gas | 0.3862 | 1.0000 | 517.8 | 4219 |
| 8Nd + $3Pb_3O_4$ | 8.218 | 5553 | 3958 | liquid | gas | 0.2803 | 0.5808 | 379.6 | 3120 |
| 2Nd + 3PdO | 8.297 | 6197 | 3237 | liquid | l-g | 0.2394 | 0.2547 | 532.7 | 4420 |
| 4Nd + $3WO_2$ | 9.016 | 4792 | 3778 | liquid | liquid | 0.0000 | 0.0000 | 362.9 | 3272 |
| 2Nd + $WO_3$ | 7.074 | 5438 | 4245 | liquid | liquid | 0.0000 | 0.0000 | 446.1 | 3156 |
| 2Ta + 5AgO | 9.341 | 6110 | 2436 | liquid | l-g | 0.4229 | 0.4562 | 466.2 | 4355 |
| 2Ta + 5CuO | 9.049 | 4044 | 2843 | liquid | l-g | 0.0776 | 0.0493 | 390.3 | 3532 |
| 6Ta + $5Fe_2O_3$ | 9.185 | 2383 | 2138 | solid | liquid | 0.0000 | 0.0000 | 235.0 | 2558 |
| 2Ta + 5HgO | 12.140 | 5285 | <4200 | liquid | gas | 0.3460 | 0.6942 | 263.3 | 3120 |
| 2Ta + $I_2O_5$ | 7.615 | 8462 | 7240 | gas | gas | 0.2875 | 1.0000 | 648.6 | 4939 |
| 2Ta + 5PbO | 10.640 | 2752 | 2019 | solid | l-g | 0.1475 | 0.3056 | 154.5 | 1644 |
| 4Ta + $5PbO_2$ | 11.215 | 4935 | 3472 | liquid | gas | 0.2604 | 0.5397 | 338.6 | 3797 |
| 8Ta + $5Pb_3O_4$ | 10.510 | 3601 | 2019 | solid | l-g | 0.2990 | 0.6196 | 225.0 | 2365 |
| 2Ta + 5PdO | 11.472 | 4344 | 3237 | liquid | l-g | 0.0575 | 0.0612 | 360.4 | 4135 |
| 4Ta + $5WO_2$ | 13.515 | 2556 | 2196 | liquid | solid | 0.0000 | 0.0000 | 145.1 | 1962 |

TABLE 1a-continued

| Thermite Reactions (in Alphabetical Order) | | | | | | | | | |
|---|---|---|---|---|---|---|---|---|---|
| reactants | | adiahatic reaction temperture (K) | | state of products | | gas production | | heat of reaction | |
| constituents | $\rho_{TMD}$, g/cm$^3$ | w/o phase changes | w/phase changes | state of oxide | state of metal | moles gas per 100 g | g of gas per g | −Q, cal/g | −Q, cal/cm$^3$ |
| 6Ta + 5$WO_3$ | 9.876 | 2883 | 2633 | liquid | solid | 0.0000 | 0.0000 | 206.2 | 2036 |
| 3Th + 2$B_2O_3$ | 6.688 | 3959 | 3135 | solid | liquid | 0.0000 | 0.0000 | 337.8 | 2259 |
| 3Th + 2$Cr_2O_3$ | 8.300 | 4051 | 2945 | solid | l-g | 0.0590 | 0.0307 | 334.5 | 2776 |
| TH + 2CuO | 8.582 | 7743 | 2843 | solid | l-g | 0.4301 | 0.3421 | 558.7 | 4795 |
| 3Th + 2$Fe_2O_3$ | 8.280 | 6287 | 3135 | solid | l-g | 0.2619 | 0.1463 | 477.9 | 3957 |
| 2Th + $Fe_3O_4$ | 8.092 | 5912 | 3135 | solid | l-g | 0.2257 | 0.1261 | 458.5 | 3710 |
| Th + $MnO_2$ | 8.391 | 7151 | 3910 | liquid | gas | 0.3135 | 0.1722 | 529.2 | 4440 |
| Th + $PbO_2$ | 10.19 | 10612 | 4673 | l-g | gas | 0.2817 | 0.6231 | 482.8 | 4922 |
| 2Th + $Pb_3O_4$ | 9.845 | 8532 | 4673 | l-g | gas | 0.2695 | 0.5633 | 360.5 | 3549 |
| Th + $SiO_2$ | 6.732 | 3813 | 2628 | solid | l-g | 0-.34 | 0-.10 | 258.2 | 1738 |
| 3Ti + 2$B_2O_3$ | 2.791 | 1498 | 1498 | solid | solid | 0.0000 | 0.0000 | 276.6 | 772.0 |
| 3Ti + 2$Cr_2O_3$ | 4.959 | 1814 | 1814 | solid | solid | 0.0000 | 0.0000 | 296.2 | 1469 |
| Ti + 2CuO | 5.830 | 5569 | 2843 | liquid | l-g | 0.3242 | 0.2060 | 730.5 | 4259 |
| 3Ti + 2$Fe_2O_3$ | 5.010 | 3358 | 2614 | liquid | liquid | 0.0000 | 0.0000 | 612.0 | 3066 |
| Ti + $Fe_3O_4$ | 4.974 | 3113 | 2334 | liquid | liquid | 0.0000 | 0.0000 | 563.0 | 2800 |
| Ti + $MnO_2$ | 4.826 | 3993 | 2334 | liquid | l-g | 0.3783 | 0.2078 | 752.7 | 3633 |
| 2Ti + $Pb_3O_4$ | 8.087 | 5508 | 2498 | liquid | gas | 0.3839 | 0.7955 | 358.1 | 2896 |
| Ti + $SiO_2$ | 3.241 | 715 | 715 | solid | solid | 0.0000 | 0.0000 | 75.0 | 243.1 |
| 2Y + 3CuO | 5.404 | 7668 | 3124 | liquid | l-g | 0.7204 | 0.4577 | 926.7 | 5008 |
| 8Y + 3$Fe_3O_4$ | 4.803 | 5791 | 3135 | liquid | l-g | 0.3812 | 0.2129 | 856.3 | 4113 |
| 10Y + 3$I_2O_5$ | 4.638 | 12416 | >4573 | gas | gas | 0.4231 | 1.0000 | 1144 | 5308 |
| 4Y + 3$MnO_2$ | 4.690 | 7405 | <5731 | gas | gas | 0.8110 | 1.0000 | 1022 | 4792 |
| 2Y + $MoO_3$ | 4.567 | 8778 | >4572 | gas | liquid | 0.6215 | 1.0000 | 1005 | 4589 |
| 2Y + $Ni_2O_3$ | 4.636 | 7614 | 3955 | liquid | gas | 0.5827 | 0.3420 | 1120 | 5194 |
| 4Y + 3$PbO_2$ | 6.875 | 9166 | >4572 | gas | gas | 0.4659 | 1.0000 | 751.0 | 5163 |
| 2Y + 3PdO | 7.020 | 8097 | 3237 | liquid | l-g | 0.4183 | 0.4451 | 768.1 | 5371 |
| 4Y + 3$SnO_2$ | 5.604 | 7022 | 4573 | l-g | gas | .37-.62 | 0.44-1 | 726.1 | 4068 |
| 10Y + 3$Ta_2O_5$ | 6.316 | 5564 | >4572 | l-g | liquid | 0-0.23 | 0-0.51 | 469.7 | 2966 |
| 10Y + 3$V_2O_5$ | 3.970 | 7243 | >3652 | l-g | gas | 0.2130 | 0.4181 | 972.5 | 3861 |
| 2Y + $WO_3$ | 5.677 | 8296 | >4572 | gas | liquid | 0.2441 | 0.5512 | 732.2 | 4157 |
| 3Zr + 2$B_2O_3$ | 3.782 | 2730 | 2573 | solid | s-l | 0.2930 | 0.0317 | 437.4 | 1654 |
| 3Zr + 2$Cr_2O_3$ | 5.713 | 2915 | 2650 | solid | liquid | 0.0000 | 0.0000 | 423.0 | 2417 |
| Zr + 2CuO | 6.400 | 6103 | 2843 | solid | l-g | 0.5553 | 0.3529 | 752.9 | 4818 |
| 3Zr + 2$Fe_2O_3$ | 5.744 | 4626 | 3135 | liquid | l-g | 0.0820 | 0.0458 | 666.2 | 3827 |
| 2Zr + $Fe_3O_4$ | 5.668 | 4103 | 3135 | liquid | l-g | 0.0277 | 0.0155 | 625.1 | 3543 |
| Zr + $MnO_2$ | 5.647 | 5385 | 2983 | s-l | gas | 0.5613 | 0.3084 | 778.7 | 4398 |
| 2Zr + $Pb_3O_4$ | 8.359 | 6595 | 3300 | l-g | gas | 0.3683 | 0.7440 | 408.1 | 3412 |
| Zr + $SiO_2$ | 4.098 | 2233 | 1687 | solid | s-l | 0.0000 | 0.0000 | 299.7 | 1228 |

There are other aspects of MIC that make it uniquely suited for the neutralization of IEDs, UXOs and similar ordnance. When incorporated into a ballistic device such as a bullet, the high density gives the bullet a high ballistic coefficient, as described above, which assists in penetrating the casing of the IED, UXO or other explosive ordnance. The MIC material also reacts upon impact but does not detonate like traditional explosive materials. Instead, its energy release is via a fast and controllable exothermic reaction inside the explosive material of an IED. The energy that is released by the MIC is primarily heat, which means that the overpressure produced by its reaction is modest unlike conventional explosive materials. The reaction rate of the MIC can also be tailored such that it is comparable to the penetration time scale. This is important in that the energy is released inside the IED and not wasted outside the IED.

Another aspect that is desirable about the MIC and is different than conventional explosive materials is its extremely high adiabatic combustion temperature, which is favorable for initiation and burning or deflagration of the explosive. These properties have been shown to be desirable for creating a self-propagating reaction front of the explosive within the IED resulting in neutralization. Lastly, it has been shown that only a small amount, e.g., a few grams, of MIC can provide a satisfactory thermal initiation to deflagrate a kilogram or more of explosives.

In addition to nano-thermites, powdered thermite material can also be used. Compacted powdered thermites have been shown to react upon impact when incorporated into a projectile. They have a high-energy release but a slower reaction rate relative to the nano-thermites.

In an embodiment of the method of the current invention, MIC material is placed within a ballistic projectile and launched at an IED. Upon impact with the IED, the thermite reaction is initiated and the ballistic projectile penetrates into the IED. The subsequent energy release of the nanoenergetic material causes the explosive material within the IED to burn or deflagrate such that the IED is neutralized with minimal external damage. In one example of the current invention, and as shown in FIG. 1, 3 grams of MIC material 103 was prepared using 80 nm aluminum (manufactured by NovaCentrix Corp (formerly named Nanotechnologies, Inc.), of Austin, Tex.) and micron bismuth trioxide (distributed by Skylighter, Inc., P.O. Box 480-W, Round Hill, Va. 20142-0480) in the ratio by weight of 15/85, respectively. The entire mix was pressed into a 1 cm diameter by 1 cm high aluminum shell 101 and capped with an aluminum disk 102. The top half of the fill was an additional 3 grams of bismuth trioxide. The assembly was then placed in a split half, polycarbonate sphere 110. The polycarbonate sphere 110 was required to fit the projectile to the inner diameter (ID) of a 25 mm gun. To simulate the neutralization of a typical IED, the projectile was launched by the 25 mm powder gun into an 81-mm mortar shell. The 800 grams of Comp B explosive material within the mortar rapidly deflagrated and the mortar case split in half. Hence, the mortar was neutralized with minimal damage.

While the current embodiment of the invention used an aluminum cylindrical shell contained within a polycarbonate sphere to contain and launch the MIC, more traditional ballistic devices, such as bullets, can be used. Also, thermite pairs other than the aluminum and bismuth trioxide can be used and more specifically reaction combinations that produce low amounts of gas. Combinations, such as, but not limited to, aluminum and molybdenum trioxide, aluminum and iron oxide, tantalum and tungsten oxide are examples of other thermite pairs that can be used. Depending on the parameters of the IED, such as shell thickness and composition, it may be desirable to adjust the reaction rate of the MIC. The reaction rate can be controlled by varying the size of the particles as well as the ratio and type of constituents. While 80 nm Al was used in the example, other sizes can be used. Generally, particles less than about 10 micron (powdered thermites), more specifically less than about 1 micron and even more specifically less than about 500 nm (i.e., nanoscale dimension) can be used. Particles having at least one dimension of less than about 250 nm (and, in some embodiments, less than about 100 nm) may further be utilized. Furthermore, while the example used 80 nm metal with a micron-sized metal oxide, both components can be nanoscale. If a faster reaction rate is desired, generally using one component that has a nanoscale dimension will result in a reaction rate that is much faster than conventional powdered thermites.

Figure 2:
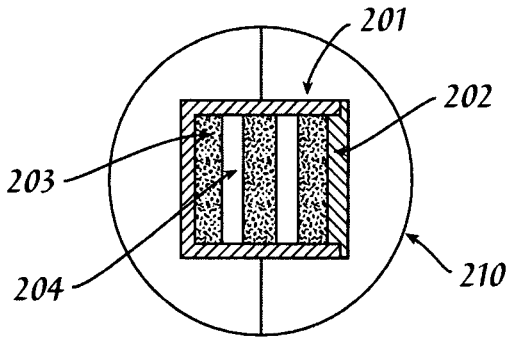
FIG. 2 shows a schematic of another embodiment of the present invention having the energetic materials segregated within the projectile.

Another embodiment of the current invention uses binary MIC or binary powdered thermite in which the two components are physically segregated within the projectile. FIG. 2 shows an example similar to the previous embodiment in which the MIC material components are segregated. In this alternative embodiment, the metal 203 and the metal oxide 204 are pressed in discrete layers within the aluminum shell 201. The shell is then capped with an aluminum disk 202 and placed inside a polycarbonate sphere 210. Upon impact with the IED or UXO, the difference in densities between the components will cause intimate mixing of the components and still cause the material to react. In the powdered form, MIC is very sensitive to electrostatic discharges and to friction, however, once it is inside the shell is it relatively insensitive. By physically segregating the components within the ballistic shell, some of the safety concerns during loading the MIC into the ballistic are mitigated. The segregation can be performed by layering the components or by using layered particles.

Again, the materials and configuration shown in FIG. 2 are for illustrative purposes and one skilled in the art will recognize that these components can be varied without departing from the current invention. For example, the binary energetic material may be comprised of two micron powders poorly mixed or it may be comprised of one component, which is a powder while the other component is a solid or liquid. An example would be aluminum foil and bismuth powder.

Another embodiment of the current invention utilizes metals that combine to exothermically form intermetallic compounds such as borides, carbides, and aluminides of titanium, zirconium, and nickel. Additional intermetallic compounds such as AlPd, RuAl, TiNi, FeAl, TiB2 also exhibit an exothermic reaction when combined. Generally, intermetallic reactions release minimal gas during their formation. This is advantageous for this invention as the energy release is primarily thermal and may be less likely to detonate the explosive in the IED. Metals that form intermetallic compounds of the current invention usually react in accordance with the following equation $$aX+bY+cZ=X_{bc}Y_{ac}Z_{ab}+\Delta\text{Energy}$$

While the reaction equation shows three metals, it could only include two metals as well as three or more metals. For the current invention, the metals are preferably in powdered form with particles at least in the low micron range, more preferably in the submicron range, and most preferably in the nanoscale range. The particles can be loosely or densely compacted within the projectile. Additionally the particles may be segregated in order to reduce the sensitivity during normal handling.

Another embodiment of the current invention uses only the oxidizer or one of the metals that exothermically forms an intermetallic compound such that it reacts with the projectile body or the IED casing. For example, bismuth trioxide can be contained within an aluminum projectile such that upon impact, the aluminum projectile body will react with the bismuth trioxide powder. Alternatively, the bismuth trioxide in the projectile, without an aluminum casing, can react with the steel casing of an IED and release energy to neutralize the IED. Another example uses nickel powder within an aluminum projectile body such that the AlNi intermetallic compounds are formed and the released energy neutralizes the IED.

Another embodiment of the current invention discloses a novel method to neutralize IED's, UXO's and similar ordnance. In this embodiment a projectile containing an energetic material comprising of at least one of MIC, binary energetic material, powdered thermite, or metals that exothermically form intermetallic compounds, or one component of the various material pairs such that it reacts with the projectile body or IED casing is launched into an IED or similar ordnance. Upon impact, the energetic material is initiated without a separate initiating device and the projectile penetrates the IED such that the explosive material within the IED or similar ordnance is exposed to the energetic material. The energetic material reacts at a rate such that the majority of the reaction energy is dissipated within the IED and causes the explosive material to burn or deflagrate rendering the IED or similar ordnance neutralized.

Figure 3:
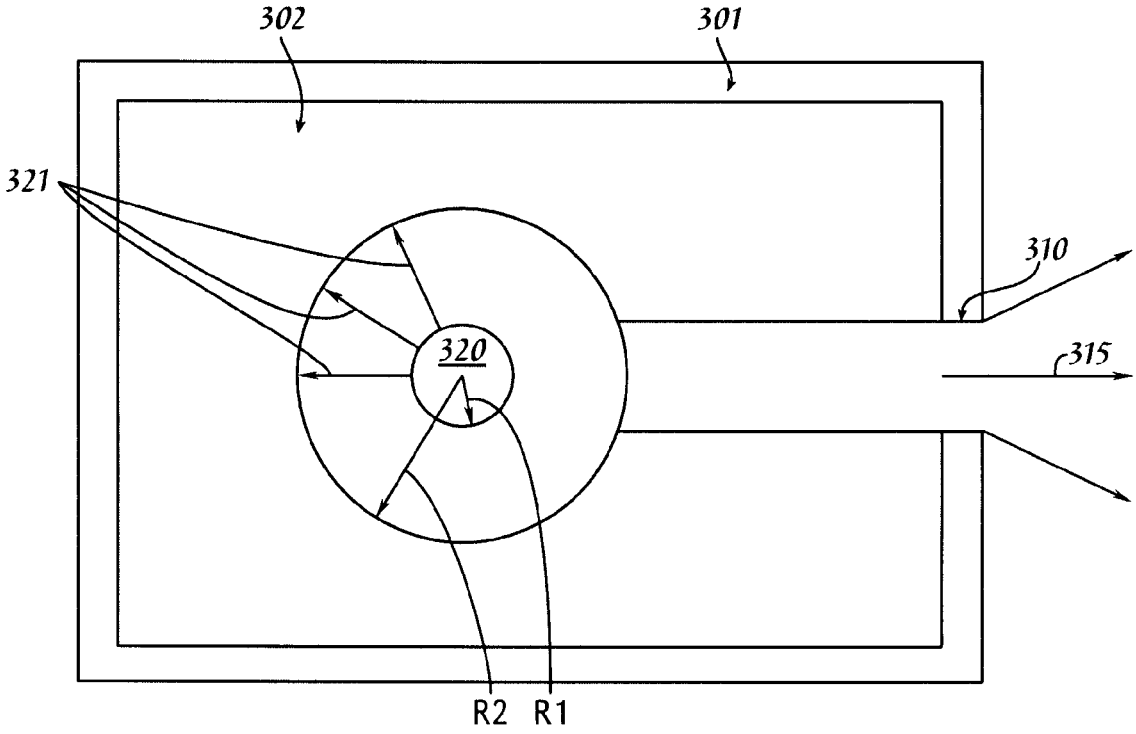
FIG. 3 shows a physics representation of an embodiment of the present invention impacting an UXO.

For the current embodiments, FIG. 3 illustrates the physics that the applicants believe may be occurring during neutralization. IED casing 301 contains an explosive material 302. In FIG. 3, the MIC bullet has penetrated the casing 301 producing an opening 310. The MIC material 320 is shown in the center of the explosive material 302 and releasing energy 321 as depicted by the arrows emanating from the MIC material. Initially, the radius of the MIC material and the cavity are $R_1$. At some later time, the explosive material has been burned away to form a cavity of diameter $R_2$ and while producing gas 315, which exits opening 310. The surface expansion of the cavity recedes at the deflagration rate. Moreover, the cavity pressure is relatively low, but the temperature inside the cavity is extremely high.

In the invention, the energetic materials are driven to rapid reaction by impact with the IED. The reaction of the components results in extremely high temperatures, however, the reaction pressures are quite modest since the reaction products are typically hot solids and liquids with only small amounts of gas. This highly exothermic, low-gaseous output may be a critical factor in preventing deflagration to detonation transition. The low gas generation is important because if the pressure inside the IED increases rapidly, it can cause any explosive material to detonate. Likewise, the size of the penetration hole in the IED can impact the internal pressure. Generally, a larger hole or multiple holes are desired to allow more gas to escape quicker.

Additionally, the high temperature more likely causes the explosive material to combust in a self-propagating manner. An advantage of the thermite formulations, and, more specifically the nano-thermite formulations, are that the reaction temperature is extremely high. Since the heat transfer to the explosive composition is by radiation, which is proportional to $T^4$, the radiation heat transfer can be significantly higher that other conventional exothermic formulations.

The unique combination of high reaction rates, high reaction temperatures, high density and low gas output provides benefits over the current state of art in IED and UXO neutralization. For example, the high density of the energetic material gives the projectile a high ballistic coefficient comparable to standard bullets. This allows the projectile of the current invention to be fired from conventional firearms from large standoff distances to provide superior protection to personnel. Also, the high ballistic coefficient of the projectile allows for good accuracy at long distances and the ability to penetrate a wide range of IED or UXO casing thicknesses.

Because the energetic material reacts upon impact, the current invention requires only one package to both penetrate and neutralize the IED, UXO or other ordnance. Additionally, unlike other methods, it does not require a separate trigger device to activate the energetic material. Moreover, because of the high reaction temperatures, only a small amount of material is required to neutralize a large amount of explosive.

While the current invention is intended primarily to neutralize IED's and UXO's, one skilled in the art would recognize that the system could also be used against conventional explosive devices, such as land mines, incoming mortars, ballistic missiles, rockets, artillery and other explosive projectiles or devices.

The above descriptions have been made by way of preferred examples, and are not to be taken as limiting the scope of the present invention. It should be appreciated by those of skill in the art that the methods and compositions disclosed in the examples merely represent exemplary embodiments of the present invention. However, those of skill in the art should, in light of the present disclosure, appreciate that many changes can be made in the specific embodiments described and still obtain a like or similar result without departing from the spirit and scope of the present invention.

What is claimed is:

1. A device for neutralizing ordnance containing explosive material, said device comprising:

a projectile; and an energetic material contained within said projectile, wherein said energetic material, in response to said projectile contacts and penetrates the casing of an ordnance containing explosive material, reacts with said explosive material within said ordnance in order to deflagrate said explosive material within said ordnance, wherein said energetic material includes a reducer and an oxidizer, both being formed in separate layers packed within said projectile.

2. The device of claim 1, wherein said reducer is a metal and said oxidizer is a metal oxide.

3. The device of claim 1, wherein said reducer is boron and said oxidizer is boron oxide.

4. The device of claim 2, wherein said metal is selected from a group consisting of aluminum, magnesium, tantalum, zirconium, tungsten, hafnium, beryllium, and combination thereof.

5. The device of claim 1, wherein said oxidizer is selected from a group consisting of bismuth trioxide, tantalum pentoxide, iron (III) oxide, iron (II,III) oxide, tungsten(IV) oxide, tungsten(VI) oxide, lead oxide, copper oxide, silver oxide, molybdenum trioxide and combinations thereof.

6. The device of claim 1, wherein said reducer and oxidizer are selected from a group consisting of aluminum and bismuth trioxide, aluminum and molybdenum trioxide, aluminum and iron oxide, aluminum and tungsten oxide, aluminum and copper oxide, aluminum and tantalum oxide, and tantalum and tungsten oxide.

7. The device of claim 1, wherein said reducer and oxidizer are separated by a barrier.

8. The device of claim 1, wherein said reducer and oxidizer are formed in separate layers within said projectile in an interleaving manner.

9. A device for neutralizing ordnance containing explosive material, said device comprising:

a projectile; and an oxidizer contained within said projectile, wherein said oxidizer, in response to said projectile contacts and penetrates the casting of an ordnance containing explosive material, reacts with said explosive material within said ordnance in order to deflagrate said explosive material within said ordnance.

10. The device of claim 9, wherein said oxidizer is selected from a group consisting of bismuth trioxide, tantalum pentoxide, iron (III) oxide, iron (II,III) oxide, tungsten(IV) oxide, tungsten(VI) oxide, lead oxide, copper oxide, silver oxide, molybdenum trioxide and combinations thereof.

11. A device for neutralizing ordnance containing explosive material, said device comprising:

a projectile; and an energetic material contained within said projectile, wherein said energetic material, in response to said projectile contacts and penetrates the casing of an ordnance containing explosive material, reacts with said explosive material within said ordnance in order to deflagrate said explosive material within said ordnance, wherein said energetic material includes a first metal and a second metal, both being formed in separate layers packed within said projectile, which is capable to react and form an intermetallic compound.

12. The device of claim 11, wherein said intermetallic compound includes AlPd, RuAl, TiNi, FeAl and $TiB_2$.

* * * * *